US012501935B2

(12) United States Patent
Park et al.

(10) Patent No.: US 12,501,935 B2
(45) Date of Patent: Dec. 23, 2025

(54) AEROSOL GENERATING APPARATUS HAVING SMOKELESS FUNCTION

(71) Applicant: KT&G CORPORATION, Daejeon (KR)

(72) Inventors: In Su Park, Daejeon (KR); Chan Min Kwon, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 389 days.

(21) Appl. No.: 18/008,527

(22) PCT Filed: Oct. 14, 2022

(86) PCT No.: PCT/KR2022/015576

§ 371 (c)(1),
(2) Date: Dec. 6, 2022

(87) PCT Pub. No.: WO2023/075237

PCT Pub. Date: May 4, 2023

(65) Prior Publication Data

US 2024/0237734 A1 Jul. 18, 2024

(30) Foreign Application Priority Data

Oct. 28, 2021 (KR) ..... 10-2021-0145543

(51) Int. Cl.
*A24F 40/57* (2020.01)
*A24F 40/42* (2020.01)
*A24F 40/46* (2020.01)

(52) U.S. Cl.
CPC ..... *A24F 40/46* (2020.01); *A24F 40/42* (2020.01); *A24F 40/57* (2020.01)

(58) Field of Classification Search
CPC ..... A24F 40/20; A24F 40/30; A24F 40/42; A24F 40/46; A24F 40/57; A24B 15/285; A24D 1/20
See application file for complete search history.

(56) References Cited

U.S. PATENT DOCUMENTS 11,197,503 B2 * 12/2021 Reevell ..... A24F 7/00
11,589,612 B2 2/2023 Jung et al.
(Continued)

FOREIGN PATENT DOCUMENTS

CA 2616120 C * 2/2021 ..... A24D 1/14
EP 3 603 426 A1 2/2020
(Continued)

OTHER PUBLICATIONS

International Search Report dated Jan. 18, 2023 in International Application No. PCT/KR2022/015576.
(Continued)

*Primary Examiner* — Abdullah A Riyami
*Assistant Examiner* — Thang H Nguyen
(74) *Attorney, Agent, or Firm* — Sughrue Mion, PLLC

(57) ABSTRACT

Provided is an aerosol generating apparatus, including: a housing that forms an accommodation space in which an aerosol generating article is accommodated; a heater unit that heats an aerosol generating article accommodated in the accommodating space; a cartridge that includes an aerosol forming agent; a cartridge heater unit that heats the cartridge; and a control unit that controls the aerosol generating apparatus to operate in a mode set among a smoky mode and a smokeless mode.

10 Claims, 1 Drawing Sheet

(56) References Cited

U.S. PATENT DOCUMENTS

| | | | | |
|---|---|---|---|---|
| 11,974,600 | B2 | 5/2024 | Park et al. | |
| 12,137,748 | B2 | 11/2024 | Lee | |
| 12,256,772 | B2 | 3/2025 | Zuber et al. | |
| 2011/0155151 | A1* | 6/2011 | Newman | A24C 5/01 131/194 |
| 2014/0305448 | A1* | 10/2014 | Zuber | A24D 1/20 131/328 |
| 2016/0157524 | A1* | 6/2016 | Bowen | A24F 40/42 |
| 2017/0119058 | A1* | 5/2017 | Cameron | A24B 15/167 |
| 2017/0280779 | A1* | 10/2017 | Qiu | G05D 23/1919 |
| 2020/0113227 | A1* | 4/2020 | Mclaughlin | A24D 3/0225 |
| 2020/0359688 | A1* | 11/2020 | Jang | A24D 1/20 |
| 2021/0068454 | A1 | 3/2021 | Jung et al. | |
| 2021/0169148 | A1 | 6/2021 | Nakano et al. | |
| 2021/0204614 | A1* | 7/2021 | Ferrie | A24F 40/50 |
| 2021/0227876 | A1* | 7/2021 | Hwang | A24D 1/042 |
| 2022/0386699 | A1* | 12/2022 | Alford | A24F 40/60 |
| 2022/0408804 | A1* | 12/2022 | Park | A24F 40/465 |
| 2023/0077221 | A1 | 3/2023 | Park et al. | |
| 2023/0329352 | A1 | 10/2023 | Lim et al. | |
| 2023/0346044 | A1 | 11/2023 | Jung et al. | |
| 2024/0389643 | A1 | 11/2024 | Park et al. | |

FOREIGN PATENT DOCUMENTS

| | | | | |
|---|---|---|---|---|
| EP | 3 818 870 | A1 | 5/2021 | |
| EP | 3 871 522 | A1 | 9/2021 | |
| EP | 3 895 556 | A1 | 10/2021 | |
| EP | 4 218 433 | A1 | 8/2023 | |
| JP | 2015-503336 | A | 2/2015 | |
| JP | 2019-41736 | A | 3/2019 | |
| JP | 2020-536575 | A | 12/2020 | |
| JP | 2021-045149 | A | 3/2021 | |
| JP | 2021-509260 | A | 3/2021 | |
| JP | 3233480 | U | 8/2021 | |
| JP | 2021-526384 | A | 10/2021 | |
| JP | 2022-542728 | A | 10/2022 | |
| KR | 10-2007-0073962 | A | 7/2007 | |
| KR | 10-2010-0127817 | A | 12/2010 | |
| KR | 10-2017-0107518 | A | 9/2017 | |
| KR | 10-2019-0049135 | A | 5/2019 | |
| KR | 10-2020-0005076 | A | 1/2020 | |
| KR | 10-2020-0031079 | A | 3/2020 | |
| KR | 10-2020-0057487 | A | 5/2020 | |
| KR | 20-2020-001637 | U | 7/2020 | |
| KR | 10-2021-0111070 | A | 9/2021 | |
| WO | WO-2007012007 | A2 * | 1/2007 | A24F 40/40 |
| WO | 2009/118085 | A1 | 10/2009 | |
| WO | WO-2014140320 | A1 * | 9/2014 | A61M 15/06 |
| WO | 2020/039589 | A1 | 2/2020 | |
| WO | 2020/064618 | A1 | 4/2020 | |
| WO | 2021/172722 | A1 | 9/2021 | |

OTHER PUBLICATIONS

Extended European Search Report dated Dec. 11, 2023 in Application No. 22813871.5.

Japanese Office Action dated Sep. 2, 2025 in Application No. 2022-575233.

* cited by examiner

【Figure 1】
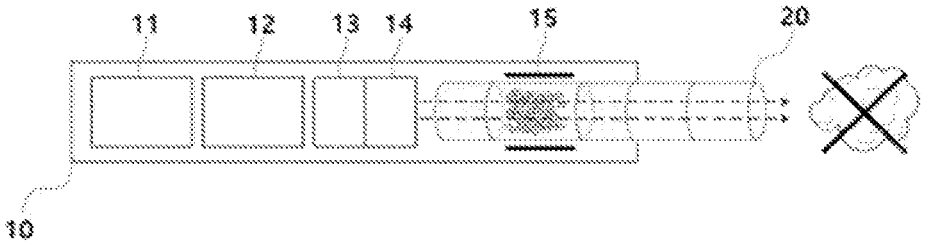
【Figure 2】
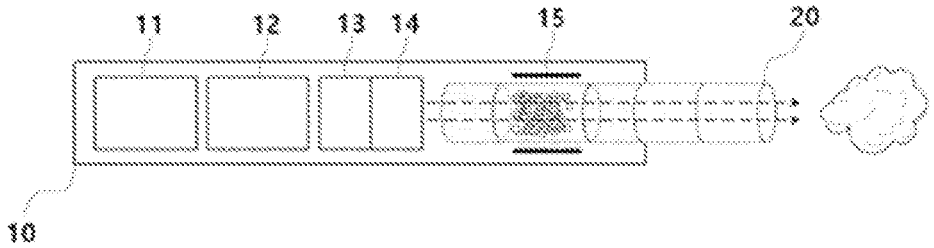
【Figure 3】
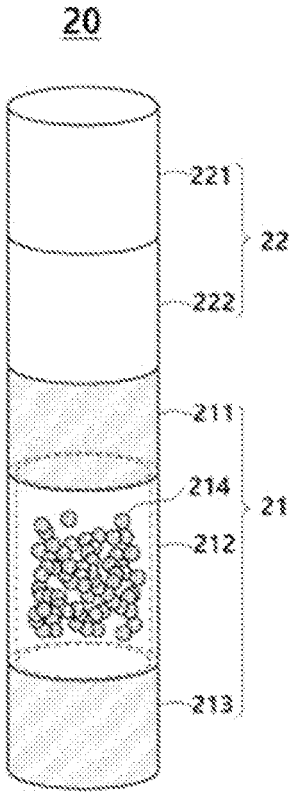

AEROSOL GENERATING APPARATUS HAVING SMOKELESS FUNCTION

TECHNICAL FIELD

The present invention relates to an aerosol generating apparatus having a smokeless function. More particularly, the present invention relates to an aerosol generating apparatus in which a user may select a smoky or smokeless function and a user may easily select a heating temperature of a heater unit under the smoky mode.

The present application claims the benefit of priority based on Korean Patent Application No. 10-2021-0145543 filed on Oct. 28, 2021, all contents of which are incorporated as a part of the present specification by reference.

BACKGROUND ART

In recent years, demand for alternative products that overcome the disadvantages of traditional cigarettes is increasing. For example, there is an increasing demand for an apparatus (e.g., cigarette-style electronic cigarette) that generates aerosols by electrically heating a cigarette stick. Accordingly, research on an electrically heated aerosol generating apparatus and a cigarette stick (or aerosol generating article) applied thereto is being actively conducted.

Meanwhile, if visible smoke is not generated during smoking, there is an advantage that a user may enjoy smoking without restriction of place or environment. In addition, due to such an advantage, smokeless tobacco products such as snuff, snus, chewing tobacco, and the like have been developed, but the exemplified smokeless tobacco products have a disadvantage that they may not provide a smoking feeling like a combustible cigarette or a heated cigarette stick. On the other hand, there are also smokers who prefer to smoke while generating visible smoke depending on their preferences.

In addition to the difference in preference according to the presence or absence of visible smoke, there is a difference in preference for a strong tobacco taste or a soft tobacco taste according to each smoker's preference for a tobacco taste that varies according to the nicotine transfer amount.

Therefore, it is necessary to research and develop an aerosol generating apparatus capable of simultaneously satisfying the difference in preferences of many smokers according to the presence or absence of visible smoke and various tobacco tastes.

PRIOR ART DOCUMENT

Patent Document (Patent Document 1) Japanese Patent Laid-Open Publication No. 2021-045149

DISCLOSURE

Technical Problem

The present inventors provide an aerosol generating apparatus capable of operating in a smoky or smokeless mode depending on selection, and adjusting a temperature of a heater unit for heating tobacco granules when operating in a smoky mode to allow a smoker to adjust the transfer amount of nicotine and flavor components according to his/her taste.

Technical Solution

According to a first aspect of the present invention, an aerosol generating apparatus includes:

a housing that forms an accommodation space in which an aerosol generating article is accommodated; a heater unit that heats an aerosol generating article accommodated in the accommodating space; a cartridge that includes an aerosol forming agent; a cartridge heater unit that heats the cartridge; and a control unit that controls the aerosol generating apparatus to operate in a mode set among a smoky mode and a smokeless mode.

In an embodiment of the present invention, the aerosol generating article may include a tobacco rod, and the tobacco rod may include a first filter segment; a second filter segment, and a cavity segment formed by the first filter segment and the second filter segment, wherein the cavity segment may be filled with a tobacco granule.

In an embodiment of the present invention, the aerosol generating article further may include a filter rod located downstream of the tobacco rod, and the filter rod may include a cooling segment and a mouthpiece segment.

In an embodiment of the present invention, the control unit may operate both the heater unit and the cartridge heater unit or operate only the cartridge heater unit in response to a determination that the set mode is the smoky mode.

In an embodiment of the present invention, the heater unit may operate in one of a strong mode, a medium mode, and a weak mode by varying a heating temperature for the aerosol generating article.

In an embodiment of the present invention, the heater unit may be heated to maintain a temperature of 200 to 260° C. in the strong mode, heated to maintain a temperature of 160 to 200° C. in the medium mode, and heated to maintain a temperature of 150 to 180° C. in the weak mode.

In an embodiment of the present invention, the control unit may operate only the heater unit of the heater unit and the cartridge heater unit in response to a determination that the set mode is the smokeless mode.

In an embodiment of the present invention, the heater unit may be heated to maintain a temperature of 200 to 260° C.

In an embodiment of the present invention, the heater unit may be disposed to heat only the cavity segment.

In an embodiment of the present invention, the heater unit may be driven in a form of re-heating when the heater unit is out of a set range after being initially preheated.

In an embodiment of the present invention, the aerosol generating apparatus may further include: a switch that is disposed on an outer wall surface of the housing, wherein the switch may be a means that sets a smoky mode or a smokeless mode, and when the smoky mode is selected, sets any one of the strong mode, the medium mode, and the weak mode.

Advantageous Effects

The aerosol generating apparatus having a smokeless function according to the present invention can select a smoky or smokeless mode according to a smoker's preference or a smoking place, and when operating in the smoky mode, a smoker can set the heating temperature of the tobacco granules in a strong, medium, or weak mode, so it is possible to feel the satisfaction of smoking while changing the transfer amount of nicotine and flavor components according to each temperature.

DESCRIPTION OF DRAWINGS

FIG. 1 is a diagram schematically illustrating an aerosol generating apparatus when operating in a smokeless mode according to an embodiment of the present invention.

FIG. 2 is a diagram schematically illustrating the aerosol generating apparatus when operating in a smoky mode according to an embodiment of the present invention.

FIG. 3 is a diagram schematically illustrating an aerosol generating article according to an embodiment of the present invention.

BEST MODE

Hereinafter, the present invention will be described in more detail.

The terms and words as used herein are not to be construed as being limited to general or dictionary meanings, and are to be construed as meaning and concepts meeting the technical idea of the present invention based on a principle that the present inventors may appropriately define the concepts of terms in order to describe their own inventions in the best manner.

The terms as used herein are used only in order to describe specific embodiments rather than limiting the present invention. Singular forms include plural forms unless the context clearly indicates otherwise. It is to be understood that the terms 'include' or 'have' as used herein specify the presence of features, numerals, steps, operations, components, parts mentioned in the present specification, or combinations thereof, and do not preclude the presence or addition of one or more other features, numerals, steps, operations, components, parts, or combinations thereof.

The terms "front" and "back" as used herein are defined based on an aerosol flow.

The term "aerosol forming agent" as used herein may refer to a material capable of facilitating the formation of visible smoke and/or aerosol. Examples of the aerosol forming agent include, but are not limited to, glycerin (GLY), propylene glycol (PG), ethylene glycol, dipropylene glycol, diethylene glycol, triethylene glycol, tetraethylene glycol, and oleyl alcohol. In the art, the aerosol forming agent may be used interchangeably with the terms such as a moisturizer and a humectant.

The term "aerosol forming substrate" as used herein may refer to a material capable of forming an aerosol. The aerosol may include volatile compounds. The aerosol forming substrate may be solid or liquid. For example, the solid aerosol forming substrate may include a solid material based on tobacco raw materials such as planar leaf tobacco, cut filler, and reconstituted tobacco, and the liquid aerosol forming substrate may include liquid compositions based on nicotine, tobacco extracts, and/or various flavoring agents. However, the scope of the present disclosure is not necessarily limited thereto. The aerosol forming substrate may further include an aerosol forming agent in order to stably form visible smoke and/or aerosol.

The term "aerosol generating apparatus" as used herein may refer to an apparatus capable of generating an aerosol using an aerosol generating article in order to generate an aerosol that may be directly inhaled into a user's lung through a user's mouth.

The term "aerosol generating article" as used herein may refer to an article capable of generating an aerosol. The aerosol generating article may include an aerosol forming substrate. A representative example of the aerosol generating article may be a cigarette, but the scope of the present disclosure is not limited thereto.

The terms "upstream" or "upstream direction" as used herein may refer to a direction that becomes distant from a user's (smoker's) mouth, and the terms ""downstream" or "downstream direction" as used herein are terms refer to a direction that becomes close to the user's (smoker's) mouth. The terms "upstream" and "downstream" are terms used to describe relative positions of elements constituting the aerosol generating article. For example, in an aerosol generating article 20, a tobacco rod 21 is located upstream or in an upstream direction of a filter rod 22, and the filter rod 22 is located downstream or in a downstream direction of the tobacco rod 21.

The term "longitudinal direction" as used herein may refer to a direction corresponding to a longitudinal axis of the aerosol generating article.

Hereinafter, embodiments of the present invention will be described in detail with reference to the accompanying drawings so that those skilled in the art to which the present invention pertains may easily practice the present invention. However, the present invention may be implemented in various different forms, and is not limited to embodiments described herein.

Hereinafter, embodiments of the present invention will be described in detail with reference to the drawings.

In the conventional aerosol generating apparatus, it is difficult for a user to directly control the generation of visible smoke, and although a smoker may prefer a specific tobacco taste according to his or her taste, the type of tobacco flavor that may be provided by operating a heater at a certain specific temperature is limited. As a result, there is a limitation in not being able to provide an aerosol generating device that satisfies many smokers' preferences.

Therefore, in order to solve the above problems, the present inventors come to invent an aerosol generating apparatus that may allow a smoker to select whether or not to generate visible smoke according to personal preference and a smoking place through operation in a smoky mode or a smokeless mode and may select a tobacco flavor according to preference by varying the temperature of the heater unit for heating the granules in several stages under the smoky mode.

In an embodiment of the present invention, the aerosol generating apparatus 10 includes a housing that forms an accommodation space in which an aerosol generating article 20 is accommodated; a heater unit 15 that heats an aerosol generating article 20 accommodated in the accommodation space; a cartridge 14 that includes an aerosol forming agent; a cartridge heater unit 13 that heats the cartridge 14; and a control unit 12 that controls the aerosol generating apparatus 10 to operate in a set mode among a smoky mode and a smokeless mode.

However, only components related to an embodiment of the present disclosure are illustrated in FIG. 1 or FIG. 2. Additionally, those skilled in the art may understand that the aerosol generating apparatus 10 may further include general-purpose components in addition to the components illustrated in FIG. 1 or FIG. 2. For example, the aerosol generating apparatus 10 may further include an input module (e.g., a button, a touchable display, etc.) for receiving a command from a user, or the like, and an output module (e.g., an LED, a display, a vibration motor, etc.) for outputting information such as an apparatus state and smoking information. Hereinafter, each component of the aerosol generating apparatus 10 will be described in detail.

In an embodiment of the invention, the aerosol generating apparatus 10 includes a housing defining an accommodation space in which the aerosol generating article 20 is accommodated. Specifically, the housing may form an appearance of the aerosol generating apparatus 10. The housing may also define the accommodation space for accommodating the aerosol generating article 20. The housing may be preferably made of a material capable of protecting internal components.

In an embodiment of the present invention, the aerosol generating article 20 accommodated in the accommodation space may include a tobacco rod 21, the tobacco rod 21 may include a first filter segment 211; a second filter segment 213; and a cavity segment 212 formed by the first filter segment and the second filter segment, and the cavity segment 212 may be filled with tobacco granules.

As illustrated in FIG. 3, in an embodiment of the present invention, the tobacco rod 21 may include a first filter segment 211; a second filter segment 213; and a cavity segment 212 formed by the first filter segment and the second filter segment. The tobacco rod 21 is a tobacco rod including a cavity or the cavity segment 212, and may supply tobacco components (or smoking flavor components) such as nicotine as it is heated.

Specifically, the first filter segment 211 may perform functions of forming the cavity segment 212, filtering and cooling an aerosol, and may be located downstream of the cavity segment 212. The second filter segment 213 may perform a function of forming the cavity segment 212 and preventing the tobacco granules from falling off. In addition, the second filter segment 213 may allow the cavity segment 212 to be disposed at an appropriate position within the aerosol generating apparatus 10 when the aerosol generating article 20 is inserted into the aerosol generating apparatus 10, and may prevent the tobacco rod 21 from escaping to the outside and prevent a liquefied aerosol from flowing from the tobacco rod 21 into the aerosol generating apparatus 10 during smoking.

In an embodiment of the present invention, a suction resistance of the first filter segment 211 or the second filter segment 213 may be about 40 $mmH_2O$/60 mm to 150 $mmH_2O$/60 mm, and preferably about 50 $mmH_2O$/60 mm to 80 $mmH_2O$/60 mm. Within such a numerical range, appropriate suckability may be ensured. In addition, the probability of occurrence of a vortex flow in the cavity segment 212 is increased by the appropriate suckability, and accordingly, an effect of uniformly heating a plurality of tobacco granules 214 may be achieved. In addition, it was confirmed that, when the filter segments are paper filters, an appropriate amount of atomization is ensured within the exemplified numerical range.

In an embodiment of the present invention, each of the first filter segment 211 and the second filter segment 213 may include a paper material.

In an embodiment of the present invention, the first filter segment 211 may include a paper material. In other words, the first filter segment 211 may be formed of a paper filter. The paper material may be preferably arranged in the longitudinal direction in order to smoothly secure an airflow path, but is not limited thereto. The paper material is hardly denatured by heat, and may thus be more easily applied to a tobacco rod portion than cellulose acetate fiber that melts or shrinks when heated to a predetermined temperature or higher.

In an embodiment of the present invention, the first filter segment 211 may include a water-resistant or oil-resistant paper material. When the first filter segment 211 includes the water-resistant or oil-resistant paper material, a problem that smoke components (e.g., moisture and an aerosol forming agent component) included in the aerosol is absorbed while passing through the first filter segment 211, such that a visible amount of atomization is decreased (e.g., a problem that an amount of atomization is decreased in the smoky mode) may be significantly reduced. For example, when the first filter segment 211 includes a general paper material, the above-described smoke components are absorbed due to hygroscopicity of the paper material, such that a visible amount of atomization may be decreased, but when the water-resistant or oil-resistant paper material described above is applied, the absorption of the smoke components described above hardly occurs, such that a problem that the amount of atomization is decreased may be solved.

In an embodiment of the present invention, the first filter segment 211 may be formed of a cellulose acetate filter. In this case, an improvement effect of removal ability of the first filter segment 211 may be achieved.

In an embodiment of the present invention, the second filter segment 213 may include a paper material. In other words, the second filter segment 112 may be formed of a paper filter. The paper material may be preferably arranged in the longitudinal direction in order to smoothly secure an airflow path, but is not limited thereto. The paper material is a material robust against heat, and may significantly alleviate a problem that a fall-off phenomenon of tobacco granules is accelerated due to a phenomenon in which a cellulose acetate fiber is in contact with an internal heating element to melt or shrink when the cellulose acetate fiber is used.

In an embodiment of the present invention, the second filter segment 213 may include a water-resistant or oil-resistant paper material, and as described above in the description of the first filter segment 211, the water-resistant or oil-resistant paper material may significantly reduce a problem that a visible amount of atomization is decreased.

In an embodiment of the present invention, the cavity segment 212 is formed by the first filter segment 211 and the second filter segment 213. The cavity segment 212 is a segment including a cavity, and may be located between the first filter segment 211 and the second filter segment 213. That is, the cavity segment 212 may be formed by the first filter segment 211 and the second filter segment 213.

The cavity segment 212 may be manufactured in various manners. For example, the cavity segment 212 may be manufactured in a form including a tubular structure such as a paper tube or may be manufactured by wrapping a cavity formed by two filter segments with a wrapper made of an appropriate material, but a method of manufacturing the cavity segment 212 is not particularly limited thereto as long as the cavity segment 212 is filled with the tobacco granules.

As illustrated in FIG. 3, in an embodiment of the present invention, the cavity segment 212 may be filled with the tobacco granules 214. In general, the tobacco granules 214 have significantly less contents of moisture and/or aerosol forming agent content than other types of tobacco materials (e.g., leaf tobacco cut filler, sheet leaf, etc.), and thus may significantly decrease generation of visible smoke generation, and accordingly, a smokeless function of the aerosol generating apparatus 10 may be easily implemented. However, a diameter, a density, a filling rate, a composition ratio of constituent materials, a heating temperature, and the like, of the tobacco granules may be various, and may change according to embodiments.

In an embodiment of the present invention, a size of the tobacco granules 214 may be about 15 meshes to 50 meshes, and preferably about 15 meshes to 45 meshes, about 20 meshes to 30 meshes. Within such a numerical range, proper hardness and the manufacturing easiness of the tobacco granules 214 may be ensured, a fall-off phenomenon of the tobacco granules 214 may be minimized, and the probability of occurrence of a vortex flow in the cavity segment may be increased.

In an embodiment of the present invention, the density of the tobacco granules 214 may be about 0.5 g/cm$^3$ to 1.2 g/cm$^3$, and preferably about 0.7 g/cm$^3$ to 0.9 g/cm$^3$. Within such a numerical range, proper hardness and the manufacturing easiness of the tobacco granules 214 may be ensured, and the probability of occurrence of a vortex flow in the cavity segment 212 may be increased.

In an embodiment of the present invention, the hardness of the tobacco granules 214 may be about 70% or more, preferably 80% or more, and more preferably 90% or more. Within such a numerical range, the manufacturing easiness of the tobacco granules 214 may be improved, and a crumbling phenomenon of the tobacco granules 214 may be minimized, such that the manufacturing easiness of the aerosol generating article 20 may also be improved. In an embodiment of the present invention, the hardness of the tobacco granules 214 may be a numerical value measured in accordance with the national standard test method KSM-1802 ("Activated carbon test method"). For details of a hardness measurement method and the meaning of the measured values, the national standard KSM-1802 is referred to.

In an embodiment of the present invention, the filling ratio of the tobacco granules 214 of the cavity segment 212 may be about 80 vol % or less, and preferably about 70 vol % less. Within such a numerical range, the probability of occurrence of a vortex flow in the cavity segment 212 may be increased. In addition, the filling rate of the tobacco granules 214 may be preferably 60 vol % or more in order to ensure an appropriate smoking flavor.

In an embodiment of the present invention, the tobacco granules 214 may include about 20 wt % or less of moisture, and preferably about 10 wt % or less of moisture. Within such a numerical range, the generation of visible smoke may be significantly decreased, and a smokeless function of the aerosol generating apparatus 10 may be easily implemented.

In an embodiment of the present invention, the tobacco granules 214 may include about 10 wt % or less of an aerosol forming agent, and preferably about 7 wt %, 5 wt %, 3 wt %, or 1 wt % of an aerosol forming agent. Alternatively, the tobacco granules 214 may not include the aerosol forming agent. Within such a numerical range, the generation of visible smoke may be significantly decreased, and a smokeless function of the aerosol generating apparatus 10 may be easily implemented.

In an embodiment of the present invention, a content of nicotine on a wet basis in the tobacco granules 214 may be about 1.0% to 4.0%, and preferably about 1.5% to 3.5%. Within such a numerical range, an appropriate level of smoking flavor may be ensured.

In an embodiment of the present invention, a content of nicotine on a dry basis in the tobacco granules 214 may be about 1.2% to 4.2%, and preferably about 1.7% to 3.7%. Within such a numerical range, an appropriate level of smoking flavor may be ensured.

In an embodiment of the present invention, the aerosol generating article 20 may be wrapped by at least one wrapper. As a specific example, the aerosol generating article 20 may be wrapped by one wrapper. As another example, the aerosol generating article 20 may be wrapped in an overlapping manner by two or more wrappers. For example, the tobacco rod 21 may be wrapped by a first wrapper, and a filter rod 22 may be wrapped by the second wrapper. In addition, the tobacco rod 21 and the filter rod 22 wrapped by individual wrappers may be coupled to each other, and the entire aerosol generating article 20 may be rewrapped by a third wrapper. If each of the tobacco rod 21 or the filter rod 22 is composed of a plurality of segments, each segment may be wrapped by an individual wrapper. In addition, the entire aerosol generating article in which segments wrapped by individual wrappers are coupled to each other may be rewrapped by another wrapper. At least one hole through which external air is introduced or internal gas is discharged may be formed in the wrapper.

As illustrated in FIG. 3, in an embodiment of the present invention, the aerosol generating article 20 may further include a filter rod 22 located downstream of the tobacco rod 21, and the filter rod 22 may include a cooling segment 222 and a mouthpiece segment 221. The filter rod 22 may be located downstream of the tobacco rod 21 to perform a filtering function for the aerosol. To this end, the filter rod 22 may include a filter material such as paper or a cellulose acetate fiber. The filter rod 22 may further include a wrapper wrapping the filter material.

The filter rod 22 may be manufactured in various shapes. For example, the filter rod 22 may be a cylindrical rod or a tubular rod including a hollow therein. In addition, the filter rod 22 may be a recessed rod. If the filter rod 22 is composed of a plurality of segments, at least one of the plurality of segments may be manufactured in a different shape. In addition, the filter rod 22 may be manufactured to generate flavor. For example, a flavoring solution may be sprayed into the filter rod 22 or a separate fiber to which a flavoring solution is applied may be inserted into the filter rod 22. As another example, the filter rod 22 may include at least one capsule (not illustrated) containing a flavoring solution.

In an embodiment of the present invention, the filter rod 22 may be composed of a plurality of segments.

In an embodiment of the present invention, the filter rod 22 may include the cooling segment 222 and the mouthpiece segment 221. Specifically, the cooling segment 222 may be manufactured in various forms. For example, the cooling segment 222 may be manufactured in forms such as a paper tube, a cellulose acetate filter in which a hollow is formed, a cellulose acetate filter in which a plurality of holes are formed, and a filter filled with a polymer material or a biodegradable polymer material, but is not limited thereto if it may perform an aerosol cooling function. The mouthpiece segment 221 may be, for example, a cellulose acetate filter (i.e., a filter made of a cellulose acetate fiber), but is not limited thereto.

As illustrated in FIG. 1 or 2, in an embodiment of the present invention, the aerosol generating apparatus includes the heater unit 15 heating the aerosol generating article accommodated in the accommodation space. Specifically, when the aerosol generating article 20 is accommodated in the accommodation space of the aerosol generating apparatus 10, the heater unit 15 may heat the aerosol generating article 20 by power supplied from a battery 11.

The heater unit 15 may be configured in various forms and/or manners. As an example, the heater unit 15 may be configured to include an electrically resistive heating element. As another example, the heater unit 15 may include an electrically insulating substrate (e.g., a substrate made of polyimide) and an electrically conductive track, and include a heating element that generates heat as current flows through the electrically conductive track. However, the scope of the present disclosure is not limited to the above-described example, and the heating element may be applicable without limitation as long as it may be heated to a desired temperature. Here, the desired temperature may be preset (e.g., when a temperature profile is pre-stored) in the aerosol generating apparatus or may be set to a desired temperature by a user.

In an embodiment of the present invention, the heater unit 15 may be configured to include a heating element operating in an induction heating manner. Specifically, the heater unit 15 may include an inductor (e.g., an induction coil) for heating the aerosol generating article 20 in the induction heating manner and a susceptor induction-heated by the inductor. The susceptor may be located inside or outside the aerosol generating article 20.

In an embodiment of the present invention, the heater unit 13 may be configured to include a heating element (hereinafter referred to as an "internal heating element") internally heating the aerosol generating article 20 and a heating element (hereinafter referred to as "external heating element") externally heating the aerosol generating article 20, or a combination thereof. The internal heating element may be formed in a shape such as a tubular shape, a needle shape, a rod shape, or the like and may be disposed to penetrate through at least a portion of an aerosol generating article 20, and the external heating element may be formed in a shape such as a plate shape or a cylinder shape and may be disposed to surround at least a portion of the aerosol generating article 20. However, the scope of the present disclosure is not limited thereto, and the shape, number, and arrangement of heating elements may be designed in various manners.

In an embodiment of the present invention, the heater unit 15 may be disposed to heat only the cavity segment 212. Specifically, when the filter segment is heated, for example, if the filter segment is a cellulose acetate filter, a problem that a fiber melts or shrinks due to heat occurs, and if the filter segment is a paper filter, a problem that a visible amount of atomization decreases due to an increase in the hygroscopicity of a paper material by heat occurs, and in order to such problems, it is preferable that the heat unit 15 heats only the cavity segment 212. In addition, deformation and release of an adhesive included in the filter may be reduced, a change in physical properties of the filter may be prevented.

As illustrated in FIG. 1 or 2, in one embodiment of the present invention, the aerosol generating apparatus 10 includes a cartridge 14 that includes an aerosol forming agent; and a cartridge heater unit 13 that heats the cartridge. The aerosol generating apparatus 10 may include a structure in which the heater unit 15 and the cartridge heater unit 13 are disposed in a line or in parallel, but the internal structure of the aerosol generating apparatus 10 is particularly limited thereto.

As illustrated in FIG. 1 or FIG. 2, in an embodiment of the present invention, the aerosol generating apparatus 10 may further include the battery 14 that includes the aerosol forming agent.

In an embodiment of the present invention, the cartridge 14 may include a liquid storage tank and a liquid delivery means. However, the cartridge 14 is not limited thereto, and may further include other components. In addition, the cartridge 14 may be manufactured to be detachable/attachable from/to the cartridge heater unit 13, or may be manufactured integrally with the cartridge heater unit 13.

In an embodiment of the present invention, the liquid storage tank may store the liquid composition. For example, the liquid composition may be a liquid including a tobacco-containing substance (or a nicotine-containing substance) or may be a liquid including a non-tobacco substance. For example, the liquid composition may include water, a solvent, ethanol, a plant extract (e.g., a tobacco extract), nicotine, a perfume, an aerosol forming agent, a flavoring agent, or a vitamin mixture. For example, the perfume may include menthol, peppermint, spearmint oil, various fruit flavor components, and the like, but is not limited thereto. The flavoring agent is a material that may include a component capable of providing various flavors and savors. The vitamin mixture may be a mixture of at least one of vitamin A, vitamin B, vitamin C, and vitamin E, but is not limited thereto. In addition, examples of the aerosol forming agent may include, but are not limited thereto, glycerin or propylene glycol.

In an embodiment of the present invention, the liquid delivery means may deliver the liquid composition stored in the liquid storage tank to the cartridge heater unit. For example, the liquid delivery means may be a wick element such as a cotton fiber, a ceramic fiber, a glass fiber, or a porous ceramic, but is not limited thereto.

As illustrated in FIG. 1 or 2, in one embodiment of the present invention, the aerosol generating apparatus 10 includes a cartridge heater unit 13 that heats the cartridge 14.

In an embodiment of the present invention, the cartridge heater unit 13 may form an aerosol by heating a liquid aerosol forming substrate (e.g., liquid composition) stored in the cartridge 14. The cartridge heater unit 13 may form an aerosol by heating, for example, the liquid composition delivered by the liquid delivery means. The formed aerosol may pass through the aerosol generating article 20 and be delivered to the user. In other words, the aerosol formed by the heating of the first cartridge heater unit 13 may move along an airflow path of the aerosol generating apparatus 10, and the airflow path may be configured so that the formed aerosol passes through the aerosol generating article 20 and be delivered to the user. The operation, the heating temperature, and the like of the cartridge heater unit 13 may be controlled by the control unit 12.

In an embodiment of the present invention, the cartridge heater unit 13 may be, for example, a metal hot wire, a metal hot plate, a ceramic heater unit, and the like, but is not limited thereto. In addition, the cartridge heater unit 13 may be composed of, for example, a conductive filament such as nichrome wire, and may be disposed in a structure wound around a liquid delivery means. However, the present invention is not limited thereto. For reference, in the art, the cartridge heater unit 13 and the cartridge 14 may be referred to as terms such as a cartomizer, an atomizer, and a vaporizer.

As illustrated in FIG. 1 or FIG. 2, in an embodiment of the present invention, the aerosol generating apparatus 10 may further include a battery 11. The battery 11 may supply power used to operate the aerosol generating apparatus 10. For example, the battery 11 may supply power to allow the heater unit 15 to heat the aerosol generating article 20, and may supply power required for the control unit 12 to operate.

In an embodiment of the present invention, the battery 11 may supply power required for electrical components such as a display (not illustrated), a sensor (not illustrated), and a motor (not illustrated) installed in the aerosol generating apparatus 10 to operate.

In an embodiment of the present invention, the aerosol generating apparatus 10 may have a smokeless function. In an embodiment of the present invention, the aerosol generating apparatus 10 may operate in a smoky mode or a smokeless mode. For example, the aerosol generating apparatus 10 that operates only in a smokeless mode or operates in a set mode of a smokeless mode and a smoky mode may be provided. Accordingly, the user may use the aerosol generating apparatus 10 without being constrained by a place or an environment, and thus, user's convenience may be significantly improved.

As illustrated in FIG. 1 or FIG. 2, in an embodiment of the present invention, the aerosol generating apparatus 10 includes a control unit 12 controlling the aerosol generating apparatus 10 to operate in the set mode of the smoky mode and the smokeless mode. Specifically, the control unit 12 may control the overall operation of the aerosol generating apparatus 10. For example, the control unit 12 may control operations of the heater unit 15 and the battery 11, and may also control operations of other components included in the aerosol generating apparatus 10. The control unit 12 may control the power supplied by the battery 11, a heating temperature of the heater unit 15, and the like. In addition, the control unit 12 may determine whether or not the aerosol generating apparatus 10 is in an operable state by confirming a state of each of the components of the aerosol generating apparatus 10.

In an embodiment of the present invention, the control unit 12 may be implemented by at least one processor. The control unit may be implemented as an array of a plurality of logic gates or may be implemented as a combination of a general-purpose microcontroller and a memory in which a program executable in the microcontroller is stored. In addition, it may be clearly understood by those skilled in the art to which the present disclosure pertains that the control unit may be implemented as other types of hardware.

In an embodiment of the present invention, the smoky mode may refer to a mode in which the aerosol is generated by the aerosol generating apparatus 10 and visible smoke is also generated. A manner of implementing the smoky mode may be various, and a specific implementation method may change according to embodiments.

In an embodiment of the present invention, the control unit 12 may operate both the heater unit 15 and the cartridge heater unit 13 or operate only the cartridge heater unit 13 in response to a determination that the set mode is the smoky mode.

In an embodiment of the present invention, when both the heater unit 15 and the cartridge heater unit 13 operate in the smoky mode, the heater unit 15 may operate in one of a strong mode, a medium mode, and a weak mode by varying a heating temperature for the aerosol generating article 20. Specifically, the heater unit 15 heats the cavity segment 212 to heat the tobacco granules 214 filled therein. Since the heating temperature increases in the order of the weak mode, the medium mode, and the strong mode according to the smoker's preference, nicotine and flavor components generated according to the heating temperature of the tobacco granules for each mode are different, so it is possible to provide smokers with various smoking flavors.

In an embodiment of the present invention, the heater unit 15 may be heated to maintain a temperature of 200 to 260° C., preferably 210 to 240° C., and more preferably 220 to 230° C. in the strong mode of the smoky mode, heated to maintain a temperature of 160 to 200° C., preferably 170 to 200° C., and more preferably 190 to 200° C. in the medium mode of the smoky mode, and heated to maintain a temperature of 150 to 180° C., preferably 160 to 180° C., and more preferably 170 to 200° C. in the weak mode of the smoky mode. As the tobacco granules are heated to the temperature of the heater unit 15 that is distinguished from each other in each mode, different tobacco flavors may be provided in each mode. Specifically, in the strong mode in which the heating temperature of the tobacco granules is the highest, the transfer amount of nicotine is large and strong stimulation is expressed, and thus, a strong tobacco taste may be provided due to the large nicotine transfer amount. On the contrary, in the weak mode in which the heating temperature of the tobacco granules is the lowest, the soft tobacco taste can be provided in that the transfer amount of nicotine is small.

In an embodiment of the present invention, when only the cartridge heater unit 13 operates in the smoky mode, even if only the cartridge 14 is heated, the aerosol including the visible smoke may be formed. Specifically, when only the cartridge heater unit 13 operates in the smoky mode, the operating temperature of the cartridge heater unit 13 may be 150 to 250° C., preferably 170 to 230° C., and more preferably 180 to 200° C.

In an embodiment of the present invention, in the smoky mode, the heater unit 15 may be driven in such a way that it is initially preheated and then reheated when its temperature deviates from a set range. Specifically, in the strong mode, the medium mode, and the weak mode, the heater unit 15 is initially preheated, such that a heating temperature of the heater unit 15 may reach a heating temperature range, and may be then lowered over time to deviate from the heating temperature range of each mode. In this case, the control unit 12 may operate the heater unit 15 so that the heater unit 15 is reheated in order for the heating temperature of the heater unit 15 to reach the heating temperature range of each mode.

In an embodiment of the present invention, the smokeless mode may refer to a mode in which the aerosol is generated by the aerosol generating apparatus 10, but the visible smoke is not generated (or a mode in which the generation of the visible smoke is minimized).

In an embodiment of the present invention, the control unit 12 may operate only the heater unit 15 of the heater unit 15 and the cartridge heater unit 13 in response to a determination that the set mode is the smokeless mode. Specifically, the control unit 12 may operate only the heater unit 15 in response to a determination that the set mode is the smokeless mode. In this case, since the cartridge 14 is not heated and only the aerosol generating article 20 is heated, the visible smoke may be prevented from being generated. Specifically, the liquid stored in the cartridge generates the aerosol including the visible smoke as it is heated, but heating of the liquid is prevented, and thus, generation of the visible smoke may also be prevented.

In an embodiment of the present invention, in the smokeless mode, the heater unit 15 may be heated to maintain a temperature of 200 to 260° C., preferably 210 to 270° C., and more preferably 220 to 230° C.

In an embodiment of the present invention, the aerosol generating article 20 may be an article filled with the tobacco granules 214. Since the tobacco granules have a very low content of moisture and/or aerosol forming agent, the smokeless mode of the aerosol generating apparatus may be more easily realized when such an aerosol generating article is used.

In an embodiment of the present invention, in the smokeless mode, the heater unit 15 may be driven in such a way that it is initially preheated and then reheated when its temperature deviates from a set range. Specifically, in the smokeless mode, the heater unit 15 is initially preheated, such that a heating temperature of the heater unit 15 may reach a heating temperature range, and may be then lowered over time to deviate from the heating temperature range of the smokeless mode. In this case, the control unit 12 may operate the heater unit 15 so that the heater unit 17 is reheated in order for the heating temperature of the heater unit 17 to reach the heating temperature range of the smokeless mode.

In an embodiment of the present invention, the aerosol generating apparatus 10 may further include a switch disposed on an outer wall surface of the housing, in which the switch may be a means setting the smoky mode or the smokeless mode and setting any one of the strong mode, the medium mode, and the weak mode when the smoky mode is selected. For example, a button-type switch may be disposed on the housing, and three buttons for strong, medium, and weak modes, respectively, and a smokeless mode button are disposed so that each mode may be set by the user. However, the button-type switch is not particularly limited thereto as long as it is a means by which the user may easily set the smoky or smokeless mode and the strong, medium, and weak modes during smoking.

Hereinafter, examples will be provided in order to help the understanding of the present invention, but the following examples are provided only for easier understanding of the present invention, and the present invention is not limited thereto.

Manufacturing Example: Manufacturing of Aerosol Generating Article

An aerosol generating article having the same structure as that illustrated in FIG. 3 was manufactured. Specifically, the aerosol generating article has a circumference of about 22 mm, a length of about 48 mm, a first filter segment of about 5 mm, a cavity segment of about 18 mm, a second filter segment of about 5 mm, a cooling segment of about 10 mm, and a mouthpiece segment of about 10 mm. Tobacco granules having a size of about 30 meshes to about 40 meshes and including about 85% of tobacco powders, about 5% of starch, and about 10% of moisture were prepared, and then filled to about 75 vol % in the cavity segment. Creep paper obtained by crimping creep base paper having a paper width of about 150 mm and a basis weight of about 60 mg/m$^2$ to about 0.5 to 1.2 mm (that is, paper on which a crimping process is performed) was injected to prepare a paper filter having a suction resistance of about 70 mm$H_2O$/60 mm, and the prepared paper filter was cut and used as the first filter segment and the second filter segment. In addition, a paper tube was used as the cooling segment, and cellulose acetate was used as the mouthpiece segment.

Example: Evaluation of Aerosol Transfer Characteristics in Aerosol Generating Apparatus Example 1

The aerosol generating article manufactured through the above-described manufacturing example was applied to an aerosol generating apparatus that includes a smoky mode and a smokeless mode as described in this specification, and includes a heater unit for heating a cavity segment, and a strong mode, a medium mode, and a weak mode.

The aerosol generating apparatus was set to the smoky mode, and the heater unit was set to the strong mode, so the aerosol generating apparatus is driven.

Example 2

The aerosol generating apparatus was driven in the same manner as in Example 1, except that the heater unit is set to the medium mode in the aerosol generating apparatus.

Example 3

The aerosol generating apparatus was driven in the same manner as in Example 1, except that the heater unit is set to the weak mode in the aerosol generating apparatus.

Example 4

The aerosol generating apparatus was driven in the same manner as in Example 1, except that the aerosol generating apparatus is set to the smokeless mode.

The aerosol transfer characteristics generated by driving the aerosol generating apparatus according to Examples 1 to 4 were shown in Table 1 below. Specifically, the aerosol transfer characteristics were measured in a smoking room in which temperature is about 22±2° C. and humidity is about 60±5%, and the aerosol generated by repeating based on 5 times per sample and 9 puffs per time was collected for each time under the CRM81 condition which is a standard measurement method of liquid electronic cigarettes whose 55 ml is inhaled for 3 seconds and waited for 27 seconds, and as a result, the average value, the standard deviation, and the coefficient of variation (CV) for the results were calculated and shown in Table 1 below.

TABLE 1

| | | Smoke component (unit: mg/stick) | | | | |
|---|---|---|---|---|---|---|
| | | TPM | Tar | Nicotine | PG | Gly |
| Example 1 (Smoky/strong) | Average | 35.4 | 22.6 | 0.84 | 3.33 | 8.49 |
| | Standard deviation | 1.4 | 0.8 | 0.12 | 0.28 | 0.90 |
| | Coefficient of variation (CV) | 3.9 | 3.5 | 14.1 | 8.5 | 10.7 |
| Example 2 (Smoky/medium) | Average | 32.5 | 21.5 | 0.44 | 3.17 | 10.84 |
| | Standard deviation | 1.6 | 1.6 | 0.11 | 0.30 | 2.08 |
| | Coefficient of variation (CV) | 5.1 | 7.2 | 24.8 | 9.3 | 19.2 |
| Example 3 (Smoky/weak) | Average | 34.2 | 23.9 | 0.27 | 3.35 | 13.69 |
| | Standard deviation | 1.8 | 1.7 | 0.09 | 0.21 | 2.21 |
| | Coefficient of variation (CV) | 5.1 | 7.1 | 33.6 | 6.3 | 16.2 |
| Example 4 (Smokeless) | Average | 16.1 | 10.5 | 0.19 | 0.09 | 0.30 |
| | Standard deviation | 2.3 | 1.4 | 0.04 | 0.01 | 0.11 |
| | Coefficient of variation (CV) | 14.2 | 13.1 | 22.9 | 8.7 | 37.3 |

*TPM: Total particulate matter/PG: Propylene glycol/Gly: Glycerin

According to Table 1, compared to Example 4 which is the smokeless mode, in Examples 1 to 3 which is the smoky mode, it was confirmed that by generating propylene glycol and glycerin components generating haze at least 35 times and 28 times or more in large amounts, respectively, and thus, the satisfaction with smoking may be improved by selecting the smoky or smokeless mode according to the smoker's preference or smoking place.

In addition, comparing Example 1 (smoky mode and strong mode) and Example 4 (smokeless mode) in which the heating conditions of the heater unit are the same, in Example 1 in which 22.6 mg/stick of tar and 0.84 mg/stick of nicotine excluding the nicotine component were transferred, tobacco granule components were carried much more smoothly by the aerosol in Example 4 in which 10.5 mg/stick of tar and 0.19 mg/stick excluding the nicotine component were transferred.

In addition, in regard to Examples 1 to 3 in which the heating temperature of the tobacco granules varies through the heater unit in the smoky mode, as a result of measuring the transfer amount of nicotine closely related to the smoking propensity of each individual smoker, it was confirmed that the transfer amount of nicotine was the largest in the "strong mode" of Example 1 in which the heating temperature is the highest and the transfer amount of nicotine gradually decreases in the order of the "medium mode" in Example 2 and the "weak mode" in Example 3, in which the temperature is gradually lowered. As a result, it was found that as the higher the heating temperature, the more the transfer amount of nicotine to provide the tobacco taste having the strong stimulation, but the lower the heating temperature, the smaller the transfer amount of nicotine to provide a gradually soft tobacco taste.

Through the above results, it was confirmed that the aerosol generating apparatus of the present invention may improve the satisfaction of smoking by providing various tobacco tastes suitable to the smoker's preference according to the selection of the strong, medium, and weak modes in the smoky mode.

Although the present invention has been described in relation to the above-described embodiments, various modifications and alterations may be made without departing from the spirit and scope of the present invention. Accordingly, these modifications and alterations fall within the scope of the claims as long as they belong to the spirit of the present invention.

DETAILED DESCRIPTION OF MAIN ELEMENTS

10: Aerosol generating apparatus
11: Battery
12: Control unit
13: Cartridge heater unit
14: Cartridge
15: Heater unit
20: Aerosol generating article
21: Tobacco rod
22: Filter rod
211: First filter segment
212: Cavity segment
213: Second filter segment
214: Tobacco granule
221: Mouthpiece segment
222: Cooling segment

The invention claimed is:

1. An aerosol generating apparatus, comprising:
a housing including an accommodation space, the accommodation space configured to accommodate an aerosol generating article;
a heater unit configured to heat the aerosol generating article accommodated in the accommodation space;
a cartridge that comprises an aerosol forming agent;
a cartridge heater unit configured to heat the cartridge; and
a control unit configured to control, by controlling at least one from among the heater unit and the cartridge heater unit, the aerosol generating apparatus to operate in a mode set among a smoky mode and a smokeless mode,
wherein the control unit is further configured to control the heater unit to operate in one of a strong mode, a medium mode, and a weak mode by varying a heating temperature for the aerosol generating article.

2. A system comprising:
the aerosol generating apparatus of claim 1; and
the aerosol generating article,
wherein the aerosol generating article comprises a tobacco rod,
the tobacco rod comprises a first filter segment, a second filter segment, and a cavity segment formed by the first filter segment and the second filter segment, and
the cavity segment is filled with a tobacco granule.

3. The system of claim 2, wherein the aerosol generating article further comprises a filter rod located downstream of the tobacco rod, and
the filter rod comprises a cooling segment and a mouthpiece segment.

4. The aerosol generating apparatus of claim 1, wherein the control unit is configured to operate both the heater unit and the cartridge heater unit or operate the cartridge heater unit, without operating the heater unit, in response to a determination that the set mode is the smoky mode.

5. The aerosol generating apparatus of claim 1, wherein the control unit is configured to control the heater unit maintain heating at:
a temperature of 200 to 260° C. in the strong mode;
a temperature of 160 to 200° C. in the medium mode; and
a temperature of 150 to 180° C. in the weak mode.

6. An aerosol generating apparatus comprising:
a housing including an accommodation space, the accommodation space configured to accommodate an aerosol generating article;
a heater unit configured to heat the aerosol generating article accommodated in the accommodation space;
a cartridge that comprises an aerosol forming agent;
a cartridge heater unit configured to heat the cartridge; and
a control unit configured to control, by controlling at least one from among the heater unit and the cartridge heater unit, the aerosol generating apparatus to operate in a mode set among a smoky mode and a smokeless mode,
wherein the control unit is configured to operates the heater unit, without operating the cartridge heater unit, in response to a determination that the set mode is the smokeless mode.

7. The aerosol generating apparatus of claim 6, wherein the heater unit is heated to maintain a temperature of 200 to 260° C.

8. The system of claim 2, wherein the heater unit is configured to heat only the cavity segment from among the cavity segment, the first filter segment, and the second filter segment.

9. The aerosol generating apparatus of claim 1, wherein the control unit is further to control the heater unit to reheat based on a temperature of the heater unit being outside a set temperature range after the heater unit is initially preheated.

10. The aerosol generating apparatus of claim 1, wherein the aerosol generating apparatus further comprises:

a switch on an outer wall surface of the housing, wherein the switch is configured to set the smoky mode and the smokeless mode, and in a case where the smoky mode is selected, set any one of the strong mode, the medium mode, and the weak mode.

* * * * *